US009799197B2

(12) United States Patent
Pham et al.

(10) Patent No.: US 9,799,197 B2
(45) Date of Patent: Oct. 24, 2017

(54) FALL PROTECTION HARNESS WITH DAMAGE INDICATOR

(71) Applicant: Honeywell International Inc., Morris Plains, NJ (US)

(72) Inventors: Hai D. Pham, Eden Prairie, MN (US); Steve D. Huseth, Plymouth, MN (US); Gina Marie Theisen, Blaine, MN (US)

(73) Assignee: Honeywell International Inc., Morris Plains, NJ (US)

( * ) Notice: Subject to any disclaimer, the term of this patent is extended or adjusted under 35 U.S.C. 154(b) by 0 days.

(21) Appl. No.: 15/012,437

(22) Filed: Feb. 1, 2016

(65) Prior Publication Data

US 2017/0221338 A1 Aug. 3, 2017

(51) Int. Cl.

| | |
|---|---|
| ***G08B 1/08*** | (2006.01) |
| ***G08B 21/18*** | (2006.01) |
| ***A62B 35/00*** | (2006.01) |

(52) U.S. Cl.

CPC ..... *G08B 21/18* (2013.01); *A62B 35/0006* (2013.01); *A62B 35/0043* (2013.01)

(58) Field of Classification Search

CPC .. G08B 21/18; A62B 35/0043; A62B 35/0006
See application file for complete search history.

(56) References Cited

U.S. PATENT DOCUMENTS

| | | | |
|---|---|---|---|
| 5,259,833 | A | 11/1993 | Barnett |
| 5,481,919 | A | 1/1996 | Brandt, Jr. |
| 6,006,860 | A | 12/1999 | Bell |
| 6,256,789 | B1 | 7/2001 | Young et al. |
| 7,091,932 | B2 | 8/2006 | Astrauskas |
| 7,106,205 | B2 | 9/2006 | Graef et al. |
| 8,556,020 | B2 | 10/2013 | Rodemer |
| 8,564,452 | B2 | 10/2013 | Schaible et al. |

(Continued)

FOREIGN PATENT DOCUMENTS

| | | | |
|---|---|---|---|
| AU | 2006207863 | A1 | 9/2007 |
| WO | WO-2014/199341 | A1 | 12/2014 |

OTHER PUBLICATIONS

"U.S. Appl. No. 14/962,671, Non Final Office Action mailed Nov. 28, 2016", 7 pgs.

(Continued)

*Primary Examiner* — Erin File
(74) *Attorney, Agent, or Firm* — Schwegman Lundberg & Woessner, P.A.

(57) ABSTRACT

A fall protection harness or fall protection static line includes one or more straps, an electrical sensing device coupled to the one or more straps, a computer processor coupled to the electrical sensing device, and a transmitter coupled to the computer processor. The one or more straps are made up of an electrically non-conducting thread and an electrically conducting thread. The electrically non-conducting thread and the electrically conducting thread are intertwined, or the electrically conductive thread is intertwined with itself. The electrical sensing device detects a disruption in current in the electrically conducting thread, a disruption in voltage in the electrically conducting thread, or a change in resistance in the electrically conducting thread, which indicates damage to the fall protection harness or a fall by a person wearing the fall protection harness.

19 Claims, 8 Drawing Sheets

(56) References Cited

U.S. PATENT DOCUMENTS

| | | | | |
|---|---|---|---|---|
| 8,665,097 | B2 | 3/2014 | Worthington et al. | |
| 8,902,074 | B2 | 12/2014 | Landry et al. | |
| 9,327,678 | B1 | 5/2016 | Stockmeier et al. | |
| 2005/0083207 | A1 | 4/2005 | Smith et al. | |
| 2007/0182534 | A1 | 8/2007 | Gregory | |
| 2008/0021718 | A1* | 1/2008 | Kaartinen | G06Q 10/087 705/325 |
| 2008/0168952 | A1 | 7/2008 | Morehead | |
| 2009/0310974 | A1 | 12/2009 | Wyble | |
| 2010/0231402 | A1 | 9/2010 | Flynt et al. | |
| 2010/0326768 | A1* | 12/2010 | Kerstetter, Jr. | E06C 7/48 182/5 |
| 2011/0103558 | A1 | 5/2011 | Hooten | |
| 2012/0050036 | A1* | 3/2012 | Landry | G08B 25/016 340/540 |
| 2012/0081214 | A1 | 4/2012 | Alan | |
| 2013/0056302 | A1 | 3/2013 | Bishop | |
| 2013/0153335 | A1 | 6/2013 | Luminet et al. | |
| 2013/0276227 | A1 | 10/2013 | Kenalty et al. | |
| 2014/0130372 | A1* | 5/2014 | Aveni | A43B 3/122 36/83 |
| 2015/0090527 | A1 | 4/2015 | Salour et al. | |
| 2015/0276521 | A1 | 10/2015 | Moore, Jr. et al. | |

OTHER PUBLICATIONS

"U.S. Appl. No. 14/962,833, Examiner Interview Summary mailed Jan. 5, 2017", 3 pgs.
"U.S. Appl. No. 14/962,833, Non Final Office Action mailed Oct. 11, 2016", 18 pgs.
"U.S. Appl. No. 14/962,833, Response filed Dec. 30, 2016 Non Final Office Action mailed Oct. 11, 2016", 12 pgs.
"Iknaia Asset and Personnel Tracking Management System for the Construction Industry", (published before Nov. 2015), 8 pgs.
"Iknaia Construction—Tracking Assets and Workers", [online]. (c) Iknaia 2014. [retrieved on Oct. 7, 2015]. Retrieved from the Internet: <URL: http://www.iknain.co.uk/construction/, (2014), 2 pgs.
"U.S. Appl. No. 14/962,671, Corrected Notice of Allowance mailed Apr. 14, 2017", 7 pgs.
"U.S. Appl. No. 14/962,671, Corrected Notice of Allowance mailed Apr. 27, 2017", 8 pgs.
"U.S. Appl. No. 14/962,671, Notice of Allowance mailed Mar. 21, 2017", 9 pgs.
"U.S. Appl. No. 14/962,671, Response filed Feb. 8, 2017 to Non Final Office Action mailed Nov. 28, 2016", 10 pgs.
"European Application Serial No. 16199192.2, Extended European Search Report mailed Apr. 6, 2017", 7 pgs.
"European Application Serial No. 16199209.4, Extended European Search Report mailed Apr. 6, 2017", 7 pgs.
"European Application Serial No. 17150486.3, Extended European Search Report mailed Mar. 28, 2017", 10 pgs.
"Radio-frequency identification—Wikipedia", [online]. [retrieved on Dec. 17, 2015]. Retrieved from the Internet: <URL: https://web.archive.org/web/20151217225716/https://en.wikipedia.org/wiki/Radio-frequency_identification, (Dec. 17, 2015), 12 pgs.
"Safety Harnesses Get Smart", (c) 2006 RFID Journal, [online]. Retrieved from the Internet : <http://www.rfidiournal.com/articles/view?2431>, (2006), 1 pg.
"U.S. Appl. No. 14/962,833, Final Office Action mailed May 30, 2017", 26 pgs.
"European Application Serial No. 17153064.5, Extended European Search Report mailed May 26, 2017", 6 pgs.

* cited by examiner

FALL PROTECTION HARNESS WITH DAMAGE INDICATOR

TECHNICAL FIELD

The present disclosure relates to fall protection harnesses and fall protection static lines, and in an embodiment, but not by way of limitation, a fall protection harness and fall protection static line with a damage indicator.

BACKGROUND

Fall protection harnesses and fall protection static lines are critical pieces of safety equipment that are integral to preventing accidents on a job site. Fall protection harnesses provide a reliable restraint system worn by a worker that is connected to a fixed anchor point on a supporting structure, such as a building under construction. Fall protection harnesses are designed to arrest a fall of a worker quickly and safely. However, when a fall occurs, the fall protection harness causes a worker to be suspended in the fall protection harness in a potentially dangerous predicament. If there is no ladder or scaffolding for the worker to climb back onto, the worker will remain suspended until additional help can arrive. Being suspended in the fall protection harness for an extended period of time can lead to serious injury or death. Consequently, a rapid response is crucial to the safety of the worker. Also, a fall protection harness can be damaged or compromised when a fall occurs, or damaged or compromised as the fall protection harness ages. Such damage and/or compromising caused by a fall or aging should be brought to the attention of the proper person or authority, and the fall protection harness should be inspected and/or retired from use.

DETAILED DESCRIPTION

Figure 1:
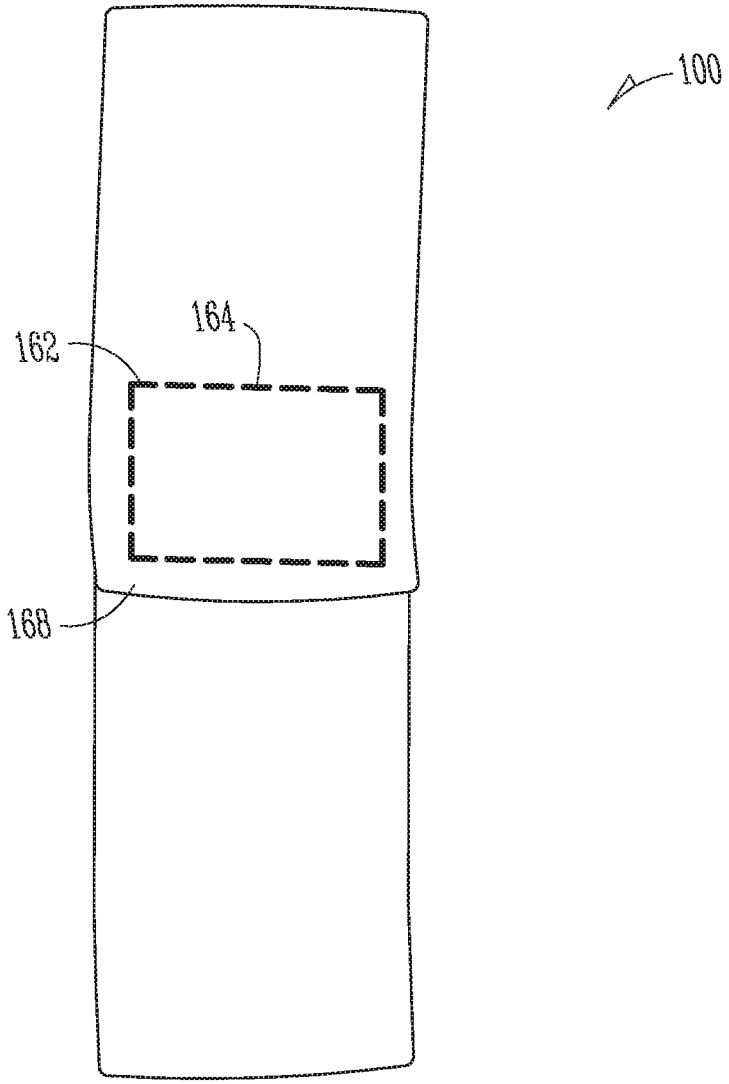
FIGS. 1 and 1A illustrate a damage indicator coupled to a fall protection harness before any damage has occurred to the fall protection harness.

In the following description, reference is made to the accompanying drawings that form a part hereof, and in which is shown by way of illustration specific embodiments which may be practiced. These embodiments are described in sufficient detail to enable those skilled in the art to practice the invention, and it is to be understood that other embodiments may be utilized and that structural, electrical, and optical changes may be made without departing from the scope of the present invention. The following description of example embodiments is, therefore, not to be taken in a limited sense, and the scope of the present invention is defined by the appended claims.

An embodiment includes a sensor that is integrated into or attached to a fall protection harness and/or a fall protection static line. The sensor is capable of automatically sensing damage to the fall protection harness, aging of the fall protection harness, and/or a fall by a person wearing the fall protection harness. When damage or aging is sensed, the fall protection harness can be examined to determine if it is still fit for further use. When a fall is detected, a responsible person can be immediately notified of the fall event so that the person in the harness can be assisted, and thereafter the fall protection harness can be examined for damaged and/or retired from use. Notifying a responsible person of a fall event reduces the response time for help to arrive and consequently reduces the amount of time the person is suspended in the fall protection harness.

In an embodiment, a fall protection harness is constructed of a nylon strap. At key locations on the harness, the nylon strap is folded over and attached (e.g., by sewing) onto itself to create a first portion of a damage or fall indicator. A second portion of the damage or fall indicator is a combination of an electrically conducting thread and an electrically non-conducting thread (the combination is for ease of thread breaking as nylon thread has more strength than the conductive thread and provides better isolation and separation when the conductive thread is broken) that is sewn into the fall protection harness. The electrically conducting thread is coupled to an electrical sensing device. In an embodiment, the electrically conducting thread and the electrically non-conducting thread are sewn into the fall protection harness at the folded over portion of the fall protection harness. When a worker falls from a height, the electrically non-conducting thread causes damage to and/or a break in the electrically conducting thread, which is sensed by the electrical sensing device, and causes a computer processor and transmitter to sound an alarm and/or transmit a signal that reports the fall to a proper authority so that the worker can be assisted and/or the fall protection harness can be inspected. The damage or fall alarm may consist of visual, acoustic, and radio frequency (RF) signals being emitted that will be detected by persons and equipment in the vicinity. In the case of damage to the fall protection harness that is not caused by a fall (such as a scraping of the harness against a rock or building structure), the proper authorities are still alerted that the fall protection harness could be damaged and should be inspected. In response to a fall by a person wearing a fall protection harness, rapidly alerting persons in the vicinity of the fall ensures rapid extraction of the fallen worker, thereby minimizing further injury and death.

Figure 1A:
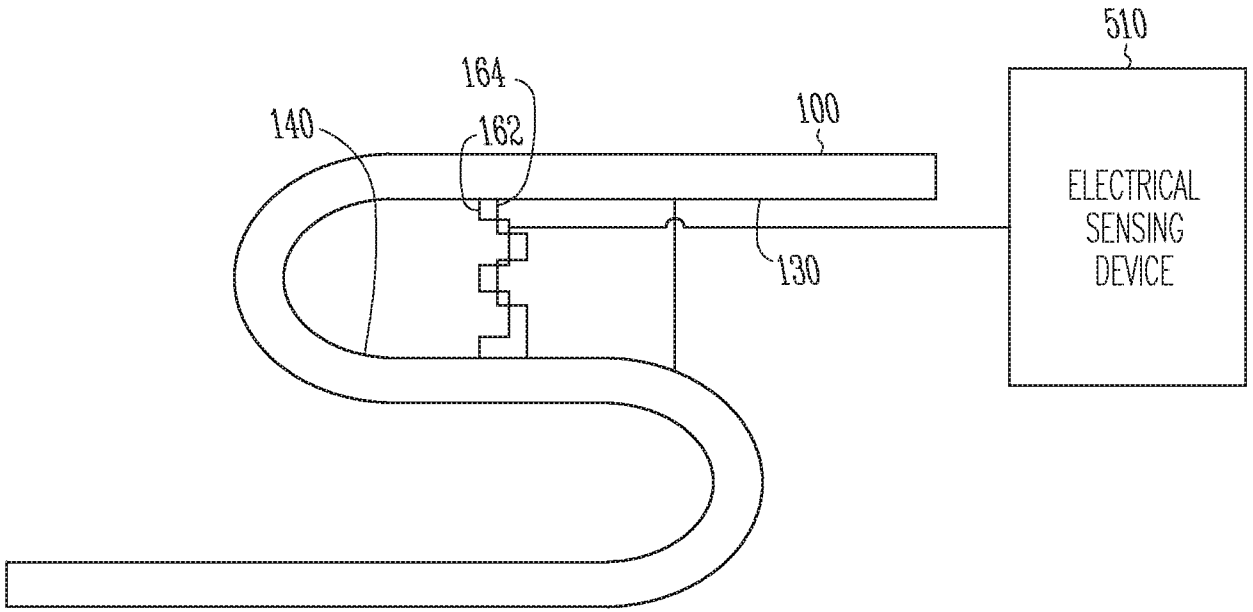
Figure 2:
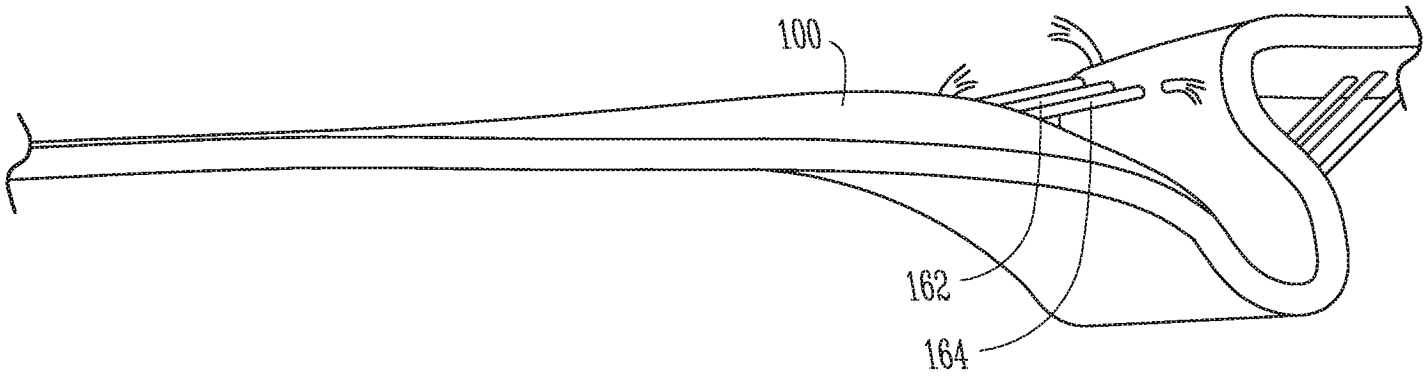
FIG. 2 illustrates a damage indicator coupled to a fall protection harness while damage is occurring to the fall protection harness.
Figure 3:
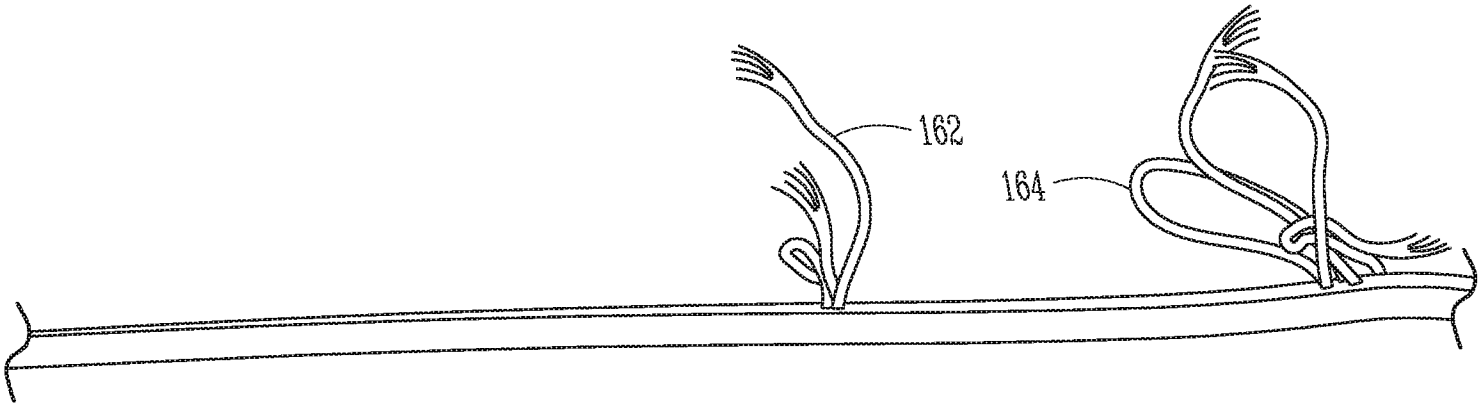
FIG. 3 illustrates a damage indicator coupled to a fall protection harness after damage has occurred to the fall protection harness.
Figure 4:
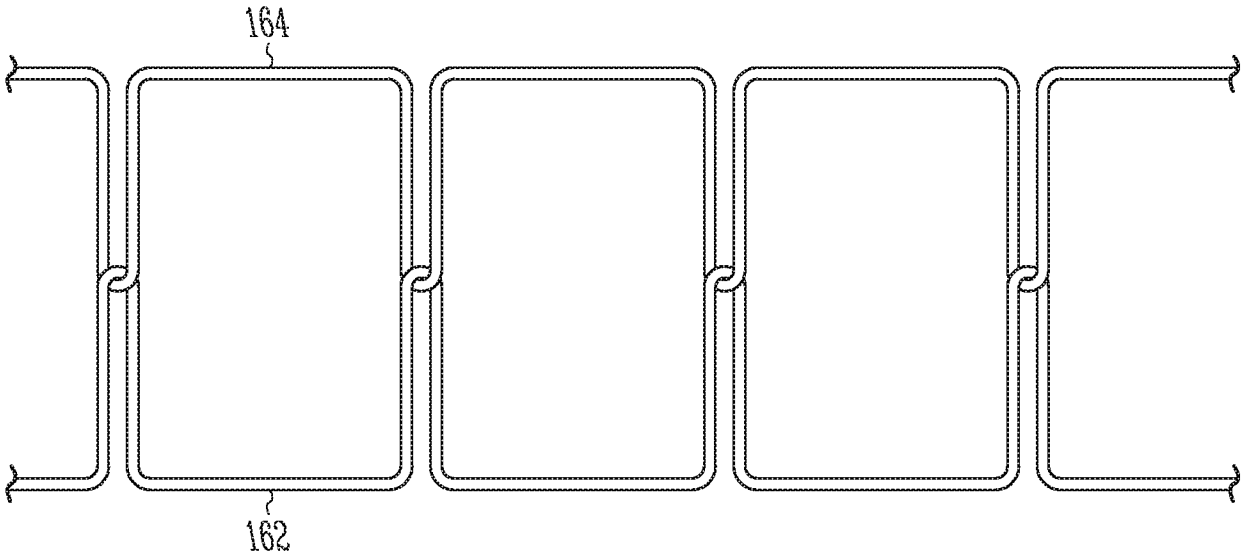
FIG. 4 illustrates a threaded hook-on pattern fir use as a damage indicator on a fall protection harness.
Figure 5:
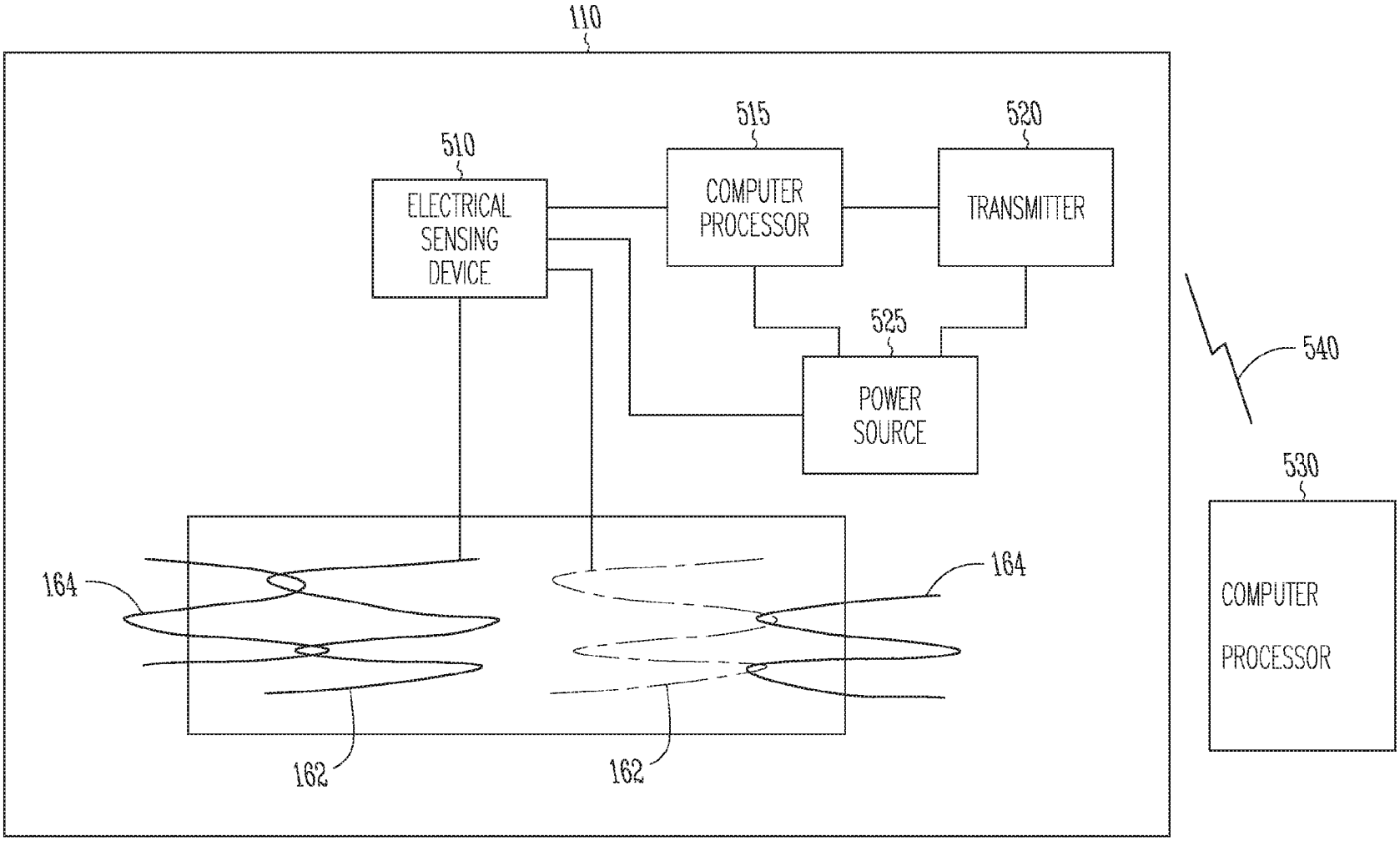
FIG. 5 illustrates a damage indicator for a fall protection harness including threaded indicator, electrical sensing device, computer processor, transmitter, and a second processor.

FIGS. 1, 1A, and 5 illustrate a damage or fall indicator coupled to a fall protection harness before any damage has occurred to the fall protection harness, and FIGS. 2, 3, and 5 illustrate a damage or fall indicator coupled to a fall protection harness after damage has occurred to the fall protection harness. More specifically, these figures illustrate a strap 100 of a fall protection harness. The strap is folded over on itself and attached via threading or other means of attachment, thereby forming a first surface 130 and a second opposing surface 140. See FIG. 1A. The threading consists in part of electrically conducting threading 162 and electrically non-conducting threading 164. In an embodiment, the electrically conducting threading 162 and the electrically non-conducting threading 164 are sewn in a hook-on pattern, and this hook-on pattern is positioned at the folded over portion of the harness 168 (See FIG. 1). FIG. 4 illustrates an example of the hook-on pattern, wherein the electrically conducting thread 162 is intertwined with the electrically non-conducting thread 164. In another embodiment, the electrically conducting thread is intertwined with itself. In yet another embodiment, the electrically conducting thread is not intertwined at all. As illustrated in FIG. 5, the electrically conducting thread 162 is coupled to an electrical sensing device 510, a computer processor 515, a transmitter 520, and a power source 525. The transmitter 520 can transmit a signal 540, which includes an alarm or other data, to a second processor 530, which can be a smart phone and/or a computer server and computer database.

Upon a fall or other damage event to the fall protection harness, the electrical non-conducting threading 164 exerts a force on the electrically conducting threading 162, causing damage to or a break in the electrically conducting thread 162, as illustrated in FIGS. 2, 3, and 5. This damage or break is sensed by the electrical sensing device 510 as a change in voltage, current, or resistance. The stitching pattern, such as the aforementioned hook-on pattern, can detect a single break in the conductive thread 162 and/or other damage to the conductive thread 162. In an embodiment, the conductive thread 162 is an uninsulated electrically conductive material such as a stainless steel fiber or a silver coated nylon thread, which is particularly positioned in the folded-over area of the strap of the fall protection harness. Absent the hook-on pattern, the conductive thread 162 could possibly short at various points, thereby causing a break at a far end of the conductive thread 162 not to be detected. However, a unique attribute of the hook-on pattern is that a single break anywhere along the length of the conductive thread 162 will result in a detectable change in voltage, resistance, current, or a combination thereof. Once a damage or fall condition is confirmed by the computer processor 515, the computer processor 515 causes the transmitter 520 to generate an alarm signal to illuminate a visual alarm, sound an acoustic alarm, and/or transmit RF alarm signals 540.

Figure 6A:
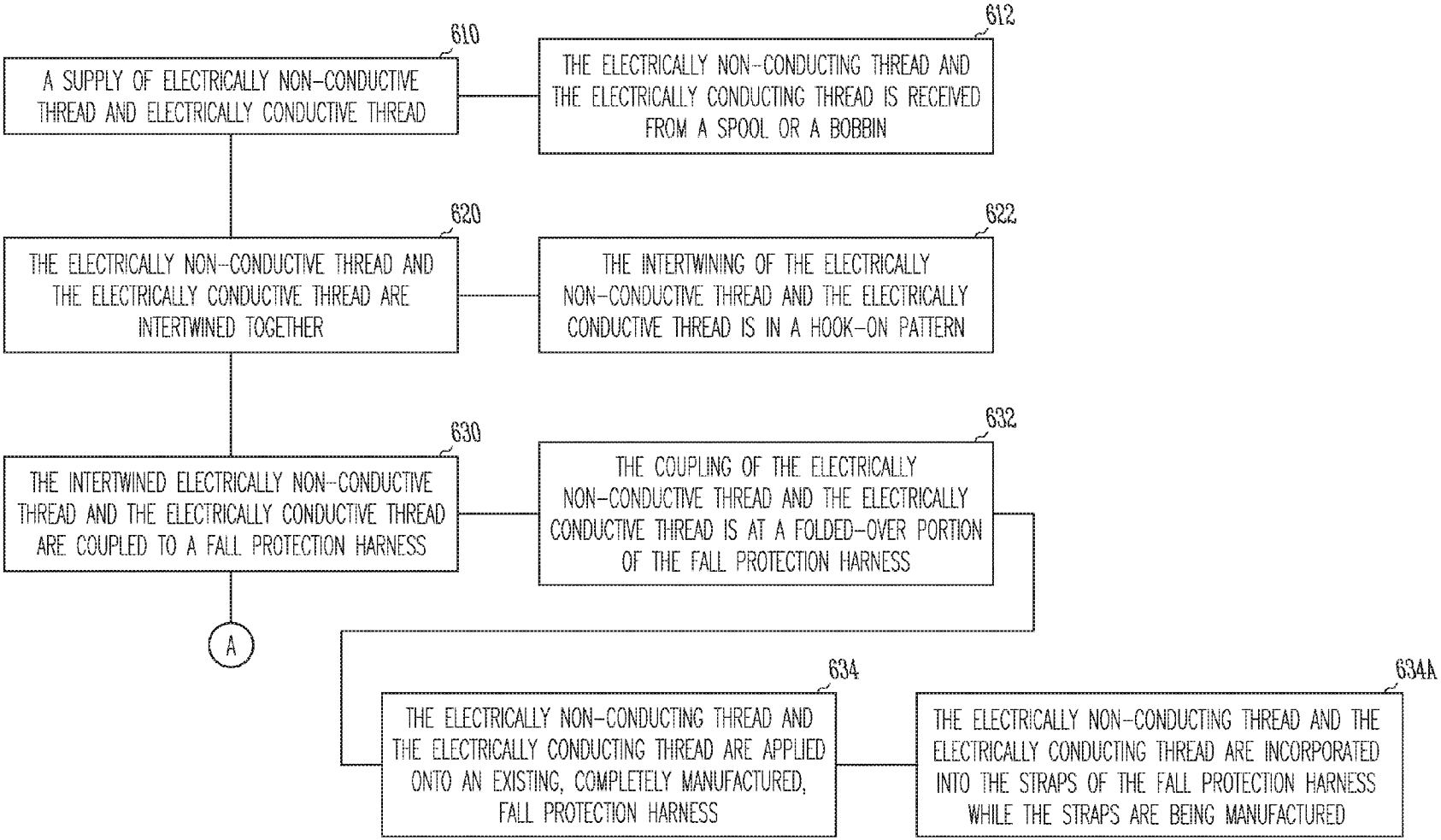
FIGS. 6A and 6B illustrate a process of manufacturing a fall protection harness with a damage indicator.
Figure 6B:
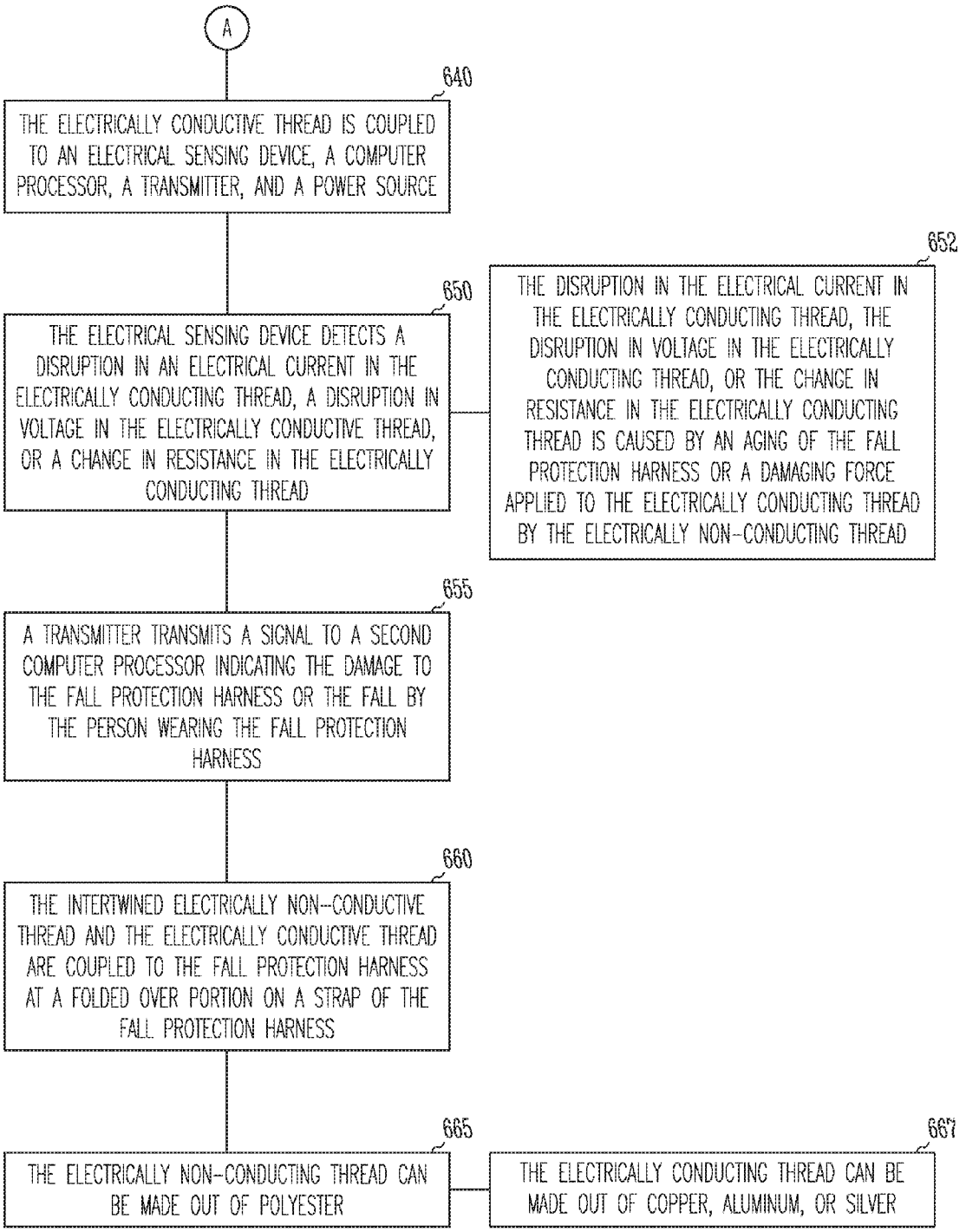

FIGS. 6A and 6B are a block diagram illustrating a process for manufacturing a fall and damage indicator for a fall protection harness, and also features of a damage and fall indicator for a fall protection harness. FIGS. 6A and 6B include a number of blocks 610-667. Though arranged substantially serially in the example of FIGS. 6A and 6B, other examples may reorder the blocks, omit one or more blocks, and/or execute two or more blocks in parallel using multiple processors or a single processor organized as two or more virtual machines or sub-processors. Moreover, still other examples can implement the blocks as one or more specific interconnected hardware or integrated circuit modules with related control and data signals communicated between and through the modules. Thus, any process flow is applicable to software, firmware, hardware, and hybrid implementations.

Referring to FIGS. 6A and 6B, the process starts at 610 with a supply of electrically non-conductive thread and electrically conductive thread. As indicated as 612, the electrically non-conducting thread and the electrically conducting thread can be received from a spool or a bobbin. At 620, the electrically non-conductive thread and the electrically conductive thread are intertwined together. This intertwining of the electrically non-conductive thread and the electrically conductive thread can be in a hook-on pattern (622). As noted above, the hook-on pattern is illustrated in FIG. 4. At 630, the intertwined electrically non-conductive thread and the electrically conductive thread are coupled to a fall protection harness. As also noted above, an example of such a coupling is illustrated in FIG. 1. At 632, the coupling of the electrically non-conductive thread and the electrically conductive thread can be at a folded-over portion of the fall protection harness. In one embodiment, the electrically non-conducting thread and the electrically conducting thread are applied onto an existing (or completely manufactured) fall protection harness (634). In another embodiment, the electrically non-conducting thread and the electrically conducting thread are incorporated into the straps of the fall protection harness while the straps are being manufactured. At 640, the electrically conductive thread is coupled to an electrical sensing device, a computer processor, a transmitter, and a power source, which is further illustrated in FIG. 5.

Block 650 illustrates that the electrical sensing device detects a disruption in an electrical current in the electrically conducting thread, a disruption in voltage in the electrically conductive thread, or a change in resistance in the electrically conducting thread. This detection of a disruption or a change indicates damage to the fall protection harness or a fall by a person wearing the fall protection harness. As indicated at 652, the disruption in the electrical current in the electrically conducting thread, the disruption in voltage in the electrically conducting thread, or the change in resistance in the electrically conducting thread is caused by an aging of the fall protection harness or a damaging force applied to the electrically conducting thread by the electrically non-conducting thread. At 655, a transmitter transmits a signal to a second computer processor indicating one or more of the damage to the fall protection harness or the fall by the person wearing the fall protection harness. The second computer processor can be a smart phone, a computer server, or any other type of computing device.

As indicated at 660, and as further illustrated in FIG. 1, the intertwined electrically non-conductive thread and the electrically conductive thread are coupled to the fall protection harness at a folded over portion on a strap of the fall protection harness. As noted at 665, the electrically non-conducting thread can be made out of polyester, and as noted at 667, the electrically conducting thread can be made out of any metal such as copper, aluminum, silver, gold, titanium, silver coated on nylon, stainless steel, or combination of several electrically conductive materials.

It should be understood that there exist implementations of other variations and modifications of the invention and its various aspects, as may be readily apparent, for example, to those of ordinary skill in the art, and that the invention is not limited by specific embodiments described herein. Features and embodiments described above may be combined with each other in different combinations. It is therefore contemplated to cover any and all modifications, variations, combinations or equivalents that fall within the scope of the present invention.

The Abstract is provided to comply with 37 C.F.R. §1.72(b) and will allow the reader to quickly ascertain the nature and gist of the technical disclosure. It is submitted with the understanding that it will not be used to interpret or limit the scope or meaning of the claims.

In the foregoing description of the embodiments, various features are grouped together in a single embodiment for the purpose of streamlining the disclosure. This method of disclosure is not to be interpreted as reflecting that the claimed embodiments have more features than are expressly recited in each claim. Rather, as the following claims reflect, inventive subject matter lies in less than all features of a single disclosed embodiment. Thus the following claims are hereby incorporated into the Description of the Embodiments, with each claim standing on its own as a separate example embodiment.

The invention claimed is:

1. A fall protection harness or fall protection static line comprising:

one or more straps:

an electrical sensing device coupled to the one or more straps;

a computer processor coupled to the electrical sensing device; and a transmitter coupled to the computer processor;

wherein the one or more straps comprise:

an electrically non-conducting thread; and an electrically conducting thread;

wherein the electrically non-conducting thread and the electrically conducting thread are intertwined and couple a first outside portion of the one or more straps to a second outside portion of the one or more straps at a folded over portion of the one or more straps, or the electrically conducting thread is intertwined; and wherein the electrical sensing device is operable to detect one or more of a disruption in current in the electrically conducting thread, a disruption in voltage in the electrically conducting thread, or a change in resistance in the electrically conducting thread, thereby indicating one or more of damage to the fall protection harness or fall protection static line, or a fall by a person wearing the fall protection harness or using the fall protection static line.

2. The fall protection harness or fall protection static line of claim 1, wherein the transmitter is operable to transmit a signal to a second computer processor indicating one or more of the damage to the fall protection harness or fall protection static line, or the fall by the person wearing the fall protection harness or the fall protection static line.

3. The fall protection harness or fall protection static line of claim 1, wherein the electrically non-conducting thread comprises polyester or nylon.

4. The fall protection harness or fall protection static line of claim 1, wherein the electrically conducting thread comprises one or more of copper, aluminum, titanium, stainless steel, silver, gold, and an electrically conductive material coated on a nylon or polyester thread.

5. The fall protection harness or fall protection static line of claim 1, wherein the electrically non-conducting thread and the electrically conducting thread are intertwined in a hook-on pattern.

6. The fall protection harness or fall protection static line of claim 5, wherein the hook-on pattern is positioned at the folded-over portion of the one or more straps.

7. The fall protection harness or fall protection static line of claim 1, comprising a power source coupled to the electrical sensing device, the computer processor, the transmitter, and the electrically conducting thread.

8. The fall protection harness or fall protection static line of claim 1, wherein the fall protection harness or fall protection static line comprises a completed manufacture, and the electrically non-conducting thread and the electrically conducting thread are incorporated onto the completed manufacture.

9. The fall protection harness or fall protection static line of claim 1, wherein the disruption in current in the electrically conducting thread, the disruption in voltage in the electrically conducting thread, or the change in resistance in the electrically conducting thread is caused by a damaging force applied to the electrically conducting thread by the electrically non-conducting thread.

10. A fall protection harness or fall protection static line comprising:

one or more straps:

an electrical sensing device coupled to the one or more straps;

a computer processor coupled to the electrical sensing device; and a transmitter coupled to the computer processor;

wherein the one or more straps comprise:

an electrically non-conducting thread; and an electrically conducting thread;

wherein the electrically non-conducting thread and the electrically conducting thread are intertwined in a hook-on pattern or the electrically conductive thread is intertwined in a hook-on pattern;

wherein the electrical sensing device is operable to detect one or more of a disruption in current in the electrically conducting thread, a disruption in voltage in the electrically conducting thread, or a change in resistance in the electrically conducting thread, thereby indicating one or more of damage to the fall protection harness or the fall protection static line, or a fall by a person wearing the fall protection harness or using the fall protection static line; and wherein the transmitter is operable to transmit a signal to a second computer processor indicating one or more of the damage to the fall protection harness or the fall protection static line, or the fall by the person wearing the fall protection harness or using the fall protection static line.

11. A fall protection harness or fall protection static line comprising:

one or more straps:

an electrical sensing device coupled to the one or more straps;

a computer processor coupled to the electrical sensing device; and a transmitter coupled to the computer processor;

wherein the one or more straps comprise:

an electrically non-conducting thread; and an electrically conducting thread;

wherein the electrically conducting thread is intertwined with itself; and wherein the electrical sensing device is operable to detect one or more of a disruption in current in the electrically conducting thread, a disruption in voltage in the electrically conducting thread, or a change in resistance in the electrically conducting thread, thereby indicating one or more of damage to the fall protection harness or fall protection static line, or a fall by a person wearing the fall protection harness or using the fall protection static line.

12. The fall protection harness or fall protection static line of claim 11, wherein the transmitter is operable to transmit a signal to a second computer processor indicating one or more of the damage to the fall protection harness or fall protection static line, or the fall by the person wearing the fall protection harness or the fall protection static line.

13. The fall protection harness or fall protection static line of claim 11, wherein the electrically non-conducting thread comprises polyester or nylon.

14. The fall protection harness or fall protection static line of claim 11, wherein the electrically conducting thread comprises one or more of copper, aluminum, titanium, stainless steel, silver, gold, and an electrically conductive material coated on a nylon or polyester thread.

15. The fall protection harness or fall protection static line of claim 11, wherein the electrically non-conducting thread and the electrically conducting thread are intertwined in a hook-on pattern.

16. The fall protection harness or fall protection static line of claim 15, wherein the hook-on pattern is positioned at a folded-over portion of the one or more straps.

17. The fall protection harness or fall protection static line of claim 11, comprising a power source coupled to the electrical sensing device, the computer processor, the transmitter, and the electrically conducting thread.

18. The fall protection harness or fall protection static line of claim 11, wherein the fall protection harness or fall protection static line comprises a completed manufacture, and the electrically non-conducting thread and the electrically conducting thread are incorporated onto the completed manufacture.

19. The fall protection harness or fall protection static line of claim 11, wherein the disruption in current in the electrically conducting thread, the disruption in voltage in the electrically conducting thread, or the change in resistance in the electrically conducting thread is caused by a damaging force applied to the electrically conducting thread by the electrically non-conducting thread.

* * * * *